United States Patent [19]

Hancock

[11] Patent Number: 4,811,671

[45] Date of Patent: Mar. 14, 1989

[54] HANDLING LIMP FABRIC

[75] Inventor: Warren J. Hancock, Victoria, Australia

[73] Assignee: Pacific Dunlop Limited, Victoria, Australia

[21] Appl. No.: 939,777

[22] PCT Filed: Mar. 21, 1986

[86] PCT No.: PCT/AU86/00074

§ 371 Date: Nov. 14, 1986

§ 102(e) Date: Nov. 14, 1986

[87] PCT Pub. No.: WO86/05467

PCT Pub. Date: Sep. 25, 1986

[30] Foreign Application Priority Data

Mar. 22, 1985 [AU] Australia ..... PG9868

[51] Int. Cl.[4] ..... D05B 21/00

[52] U.S. Cl. ..... 112/121.26; 112/305; 223/61

[58] Field of Search ..... 112/121.26, 121.15, 112/121.12, 121.27, 305; 223/61; 38/102

[56] References Cited

U.S. PATENT DOCUMENTS

| | | | |
|---|---|---|---|
| 3,742,878 | 7/1973 | Byrne et al. | 112/121.12 |
| 3,869,997 | 3/1975 | German | 112/121.12 |
| 4,062,309 | 12/1977 | Pollmeier et al. | 112/121.15 |
| 4,066,026 | 1/1978 | Hunt | 112/121.26 X |
| 4,080,912 | 3/1978 | Marjorio | 112/121.15 |

*Primary Examiner*—H. Hampton Hunter
*Attorney, Agent, or Firm*—Fred Philpitt

[57] ABSTRACT

A method and apparatus for stretching and folding a limp fabric piece (40) comprising transporting the fabric piece (40) in a stretched condition to foldable support (41), mechanically, sequentially gripping and stretching marginal portions (46) of the fabric piece (40) on each side of the fold line (51) of the foldable support (41) by means of selectively operable fingers (45), folding one section (50) of the foldable support (41) over the other, clamping overlapping marginal portions (46), unfolding the foldable support (41) while concurrently releasing fingers (45) from engagement with the fabric piece (40).

4 Claims, 3 Drawing Sheets

HANDLING LIMP FABRIC

This invention relates to the handling of limp fabric in manufacturing processes.

The fabrication of garments from fabric is currently a labour intensive process, principally because of the lack of mechanical means for holding pieces of fabric as they are subjected to various operations including transporting, feeding through machines such as sewing machines, and folding.

It is an object of the present invention to provide a method and apparatus for mechanically stretching a limp fabric piece to enable subsequent folding and sewing of the folded fabric piece.

It is a further object to provide a method and apparatus for mechanically folding a limp fabric piece to enable subsequent sewing of the folded fabric piece.

There is thus provided by the present invention a method of holding a limp fabric piece having a grippable marginal portion comprising deliverying the fabric piece onto a surface in a substantially flat state with said marginal portion tensioned, and gripping the fabric piece at or adjacent each end of the marginal portion to anchor said ends with respect to said surface.

Conveniently the fabric piece is delivered to the surface by being subjected to a sliding movement over a low friction surface. Preferably the surface which receive the fabric piece, and the one from which it is moved, are both low friction surfaces and are arranged substantially co-planar. The friction piece may be frictionally engaged on the exposed surface thereof, by a transfer member. As the fabric piece is supported on one side on the lower friction surface, and is frictionally gripped on the other side by the transfer member, movement of the transfer member relative to the low friction surface will slide the fabric piece on the low friction surface. In this way the fabric piece may be moved while held in a flat state in a prescribed path over the lower friction surface.

The marginal portion may be rendered grippable by many ways including any form of ridge projection or localised thickening of fabric. Examples are elasticising, hemming, binding, etc. In the following description we shall refer specifically to an elasticised marginal position but this is to be considered as exemplary only.

The fabric piece may be held by the friction engagement with the transfer member and moved in a prescribed path so a portion thereof passes through a sewing head as it is moved along said path. The sewing head may apply an elastic thread in a tensioned state to a marginal portion of the fabric piece. The interaction of the fabric piece with the low friction surface, and the transfer member applying frictional grip to the fabric piece, results in the fabric piece remaining in a flat state, with the elasticised marginal portion under tension and substantially flat.

The fabric piece held in this condition may be further moved on the low friction surface in response to movement of the transfer member. The fabric piece may thus be moved into a position on the supporting surface wherein the ends of the elasticised marginal portion may be gripped and anchored as previously described, so the fabric piece may be released from frictional grip with the transfer member, and the elasticised marginal portion will remain tensioned. The fabric piece is thus maintained in a flat state on the support surface so the further operations may be performed thereon. If the ends of the elasticised marginal portion were not so gripped or anchored, folds and irregularities could develop in the fabric upon release and relaxation of the elasticised portion.

In some garments there may be two elasticised marginal portions, each intersecting an edge or area of the fabric piece which is to be sown subsequent to the elasticising of the marginal portions. In such a garment it is necessary to hold both elasticised portions so the edge or area to be sown is flat and faut, and not distorted by the elasticised portions.

To achieve this desired result there is provided by one aspect of the present invention a method of handling a limp fabric piece having two spaced elasticised portion comprising delivering the fabric piece in a substantially flat state onto a surface, gripping each elasticised portion at a selected location, and pulling the respective elasticised portions at said locations in opposite directions to tension the fabric between said locations.

The pulling of the fabric in opposite directions, and the resulting tension in the fabric, will flatten the fabric between the selected locations so that a sewing or like operation may be performed thereon.

Conveniently the two elasticised portions terminate at respective spaced locations at or adjacent an edge of the fabric piece. The gripping and pulling of the elasticised portion is effected adjacent said edge, so the edge is tensioned, straightened and flattened for the subsequent performance of a hemming, overlocking or other sewing operation.

Preferably, after the fabric between the spaced locations has been tensioned and flattened, it is clamped to the surface supporting the fabric piece along the major part of, and preferably along substantially the whole of, the distance between the spaced locations. If the locations are adjacent an edge of the fabric piece, the clamping may be applied inward from that edge to permit a sewing operation to be performed on the marginal portion of the fabric along said edge.

In accordance with another aspect of the invention there is provided a method of folding a limp fabric piece to superimpose two portions of the fabric piece, comprising supporting a limp fabric piece in a flat state on a support surface having two sections mounted for rotation relative to one another about an axis transverse of the surface, positioning the fabric piece so the line along which it is to be folded is in the plane of said axis, gripping the fabric piece at a plurality of locations along its perimeter so respective portions of the fabric piece are anchored to each section of the support sections to fold the fabric piece along said fold line so the portions thereof secured to the respective section of the support surface are superimposed, clamping said folded sections of said fabric piece to said support surface, releasing said gripping hold on said fabric piece while returning said sections of the support surface to their original position.

Conveniently, if the fabric piece has an elasticised portion, the fabric piece is positioned on the support surface with the elasticised portion in tension. In this way the fabric piece is in a substantially flat state. Preferably the locations at which the fabric piece is gripped are selected, so the elasticised portion is retained in the tensioned state on the support surface, during and subsequent to the pivotal movement of the support surface sections that effects folding of the fabric piece.

If, as previously discussed, the fabric piece has two elasticised portions each extending to the same edge or area of the fabric piece, on the one side of the fold line, then the elasticised portions may each be gripped at or in said edge or area. Conveniently, after being gripped the elasticised portions may be pulled in opposite directions to tension the fabric between the locations at which it is gripped. This tensioning of the fabric will ensure the edge or area is in a flat state for subsequent operations thereon, such as sewing or the like.

The fabric piece may have two edges or areas that are tensioned as above described, one gripped to each section of the support surface, and located so that, when the fabric piece is folded, the two edges or areas are in superimposed relation. Once the edges or areas are so positioned they may be clamped in position on the lower section of the support surface, and a sewing or like operation may then be performed thereon.

Conveniently, the limp fabric is supported in a flat state on said support by means of a transfer member having a high friction surface in engagement with said fabric piece and allowing exposure of a peripheral marginal portion of said fabric piece, said engagement being terminated after the anchoring of the respective portions of the fabric piece.

Advantageously, the gripping of the fabric piece at each location is carried out by a finger actuated unit which actuates a gripping finger to sequentially perform the following movements:

(1) Upward pivotal movement from a position substantially level with the supporting surface to a position enabling the free end of the finger to clear the fabric piece, (2) Forward movement to a position where free end of finger is adjacent said elasticised portion, (3) Downward movement to grippingly engage the free end of the finger with said fabric piece, (4) Retraction of finger to predetermined position to tension said fabric piece.

In accordance with another aspect of the present invention there is provided a device for gripping and pulling a marginal portion of a fabric piece comprising a support adapted for attachment to a member upon which a fabric piece may be supported, a finger mounted on the support to occupy a retracted position substantially at or below the surface of the member upon which the fabric piece is to be supported and selectively movable to an extended position in which a free end portion of the finger is above the level of said surface, means operable to effect movement of the finger relative to the support when in said extended position to locate said free end portion in gripping engagement with a marginal portion of a fabric piece located on the support member, and when so located urge the finger in a selected direction to thereby pull the fabric in said direction.

Conveniently the finger is supported so as to be resiliently urged toward said retracted position, and selectively operable means are provided to move the free end of the finger into said extended position. Said selectively operable means may include a motor means such as an air or hydraulic cylinder. Preferably the finger is supported for reciprocating movement generally in the direction of the length of the finger to locate the free end of the finger above the marginal portion of the fabric piece, and to pull the fabric when gripped by the free end of the finger. Conveniently, the finger support responsible for the reciprocating movement is also resiliently biased towards the retracted position and is actuated for forward movement by our selectively operable means eg. an air or hydraulic cylinder.

The gripping finger may be used to initially grip an elasticised marginal portion of a piece of fabric and pull it in a direction to straighten and/or tension that portion or an adjoining portion of the fabric piece. The gripping finger may be withdrawn and retracted after the pulling action has been completed.

A plurality of gripping fingers may be used to hold the fabric piece on the respective sections of the support member used to hold the fabric piece during folding thereof. In particular the gripping fingers may be located at opposite ends of an edge or area of fabric that is to be straightened and flattened for subsequent processing, such as sewing hemming.

The invention will now be described and illustrated with reference to accompanying drawings wherein.

Figure 3A:
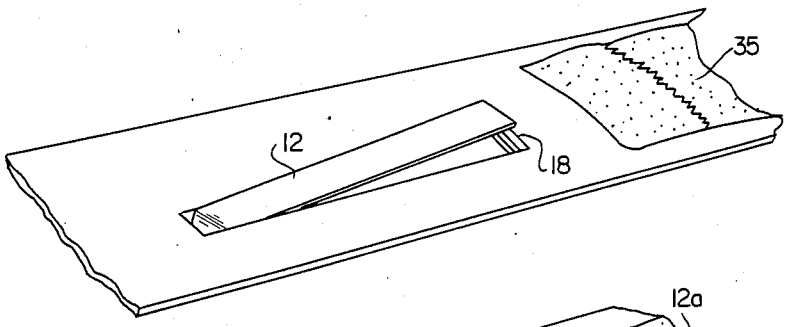
Figure 3B:
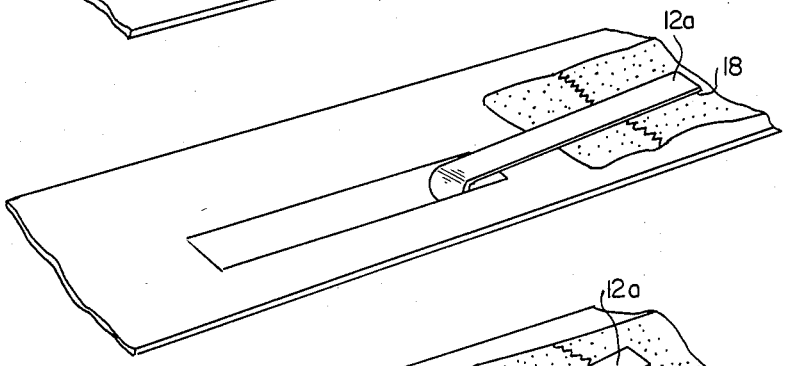
Figure 3C:
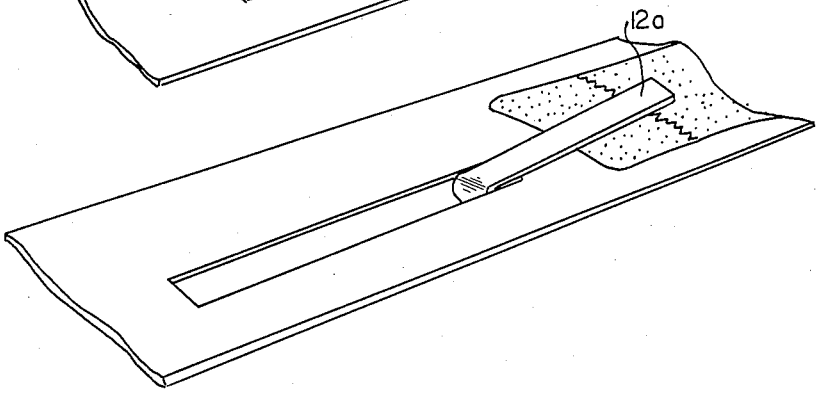
Figure 3D:
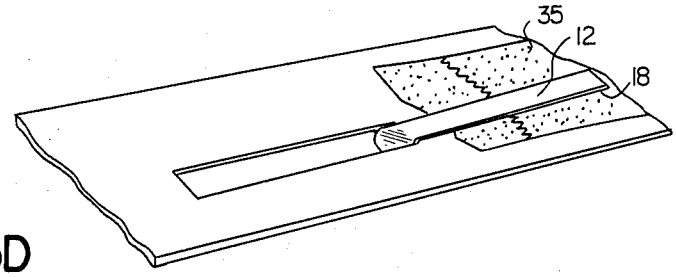
Figure 4:
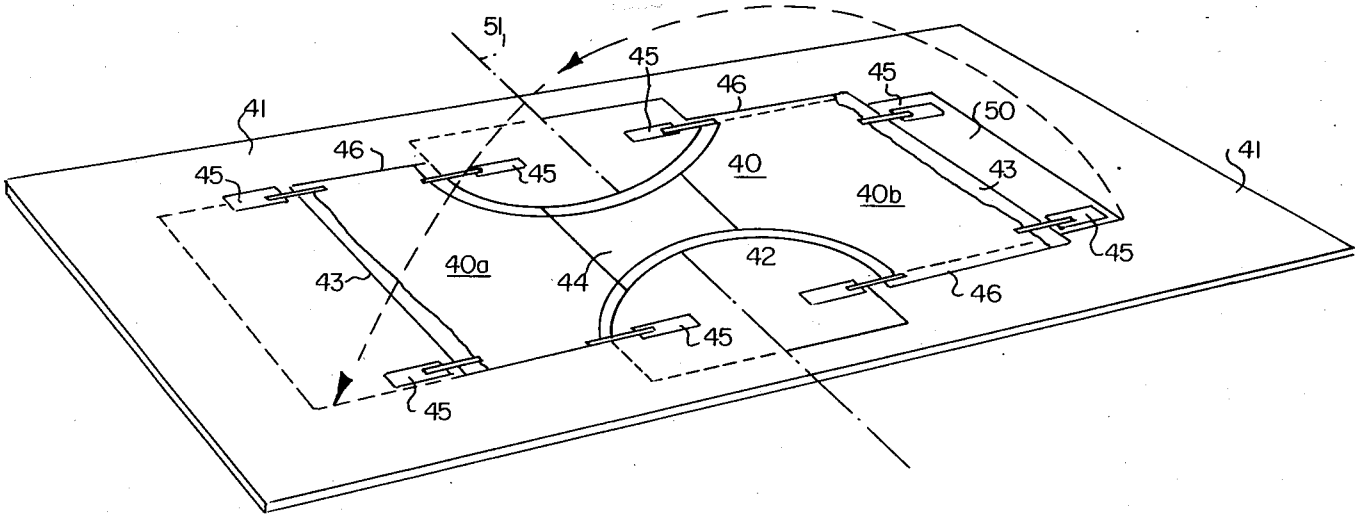

FIGS. 3*a* to *d* show various stages in the progressive engagement of the finger with the fabric piece and stretching thereof; and FIG. 4 shows a fabric piece supported on a foldable table in the stretched position.

The combined gripping and holding finger unit comprises a base number 10 adapted to be fitted into a support member 11, upon which a piece of fabric is to be supported. Finger 12 is substantially flush with the upper surface 11a of the support member and is made of a resilient material such as spring steel, and is anchored to a carrier member 16 at one end 14. The opposite end 12*a* of finger 12 is free and is provided with a gripping configuration 18 on the under-side.

The carrier member 16 is slidably mounted on rod 20, secured in parallel relationship to the base member 10. The rod 20 is parallel to the direction of the length of finger 12. The carrier member 16 is urged in the direction towards the left in FIG. 1 by spring 21 mounted on rod 20. Carrier member 16 carrying finger 12 is coupled by the bracket 23 to the double acting power cylinder 24, which is coupled to the base member 10. Accordingly, actuation of the cylinder 24 will move the carrier 16 and finger 12 to the right of FIG. 1.

Mounted on the upper side of carrier member 16, beneath finger 12 is a power cylinder 28. Activation of the power cylinder will deflect finger 12 so the free end 12*a* is raised above the upper surface 11*a* of the base support member 11.

The operation of the gripping finger unit will now be described with reference to FIG. 3 of the drawings which shows diagrammatically the sequence of movements of finger 12.

FIG. 3A shows finger 12 with the forward end 12A thereof raised above the level of base support upper surface 11A upon which the elasticised fabric piece 35 is supported. The raising of finger 12 is effected by activation of cylinder 28.

Figure 1:
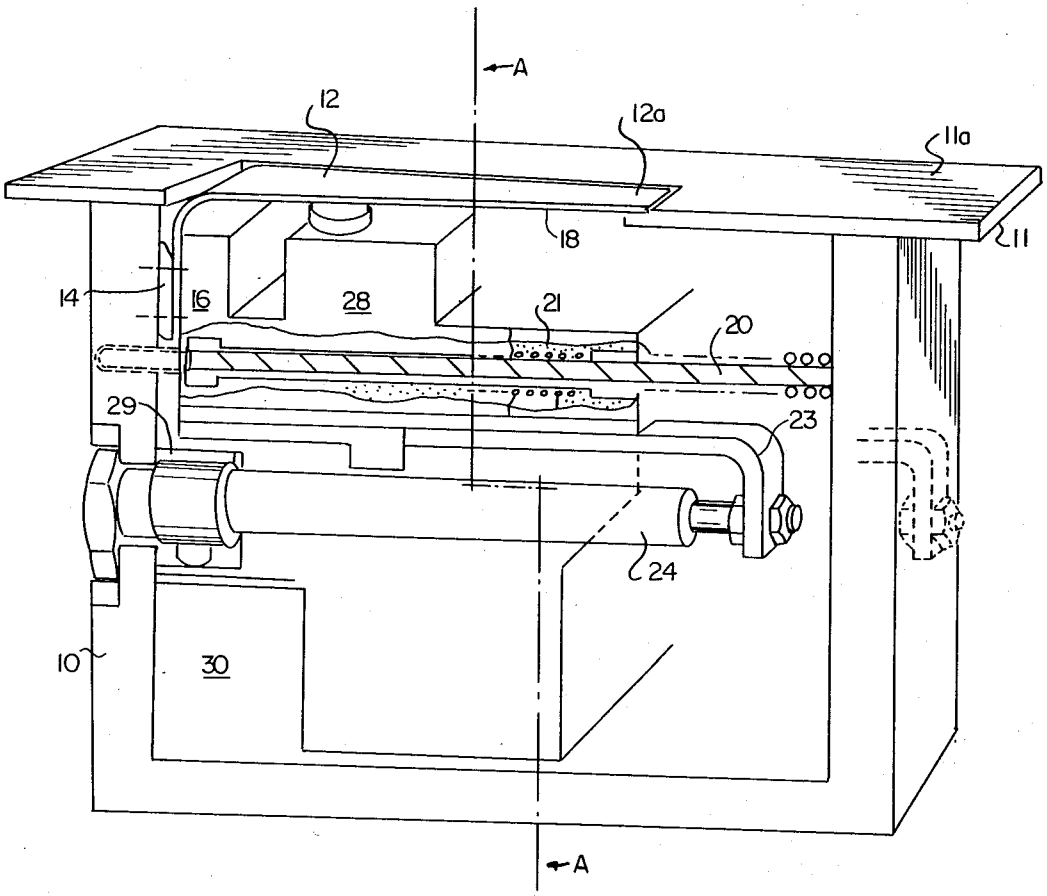
FIG. 1 is a side view of the device according to the invention.

Cylinder 24 is then activated to move the carrier to the right in FIG. 1, until the carrier member 16 abuts the right hand end of base member 10. Finger 12 will now occupy the position shown in FIG. 3B with the free end portion 12*a* above the marginal portion of the fabric piece 35.

Cylinder 28 below the finger 12 is now lowered to bring the free end portion 12 thereof into gripping engagement with the fabric piece 35 (FIG. 3C) and the cylinder 30 is activated to raise the stop member 29 to a position behind the carrier member 16. Cylinder 24 is now activated to allow the carrier member 16 to return to an intermediate position as determined by the carrier member 16 abutting the stop member 29.

During the withdrawal movement of the carrier member 16 to the intermediate position, as the finger 12, and particularly the gripping configuration 18, is in engagement with the fabric 25, the marginal portion of the fabric piece will be drawn to the left as seen in FIG. 3D. This drawing or pulling of the fabric will straighten and tension the fabric so that it will lie flat on the bench surface. This may be assisted if the opposite marginal portion of the fabric piece is also gripped by a further finger unit.

The fabric piece is now held in position on the bench surface by the finger 12, a number of which are provided at spaced locations about the perimeter of the fabric piece. When the necessary further operations on the fabric piece are completed, and it is no longer required to be held in position, the finger 12 may be raised by the cylinder 28 therebelow and returned to abut the left hand end of base member 10 by deactivating the cylinder 24.

It will be appreciated that while the fabric piece is being stretched on the support member, the fabric piece is engaged by the transport member (not shown) which, before folding seciton 50, is retracted.

When the carrier member 16 and finger 12 are fully retracted the cylinder 28 below the finger 12 may be deactivated to permit the finger 12 to be lowered to its original position.

Figure 2:
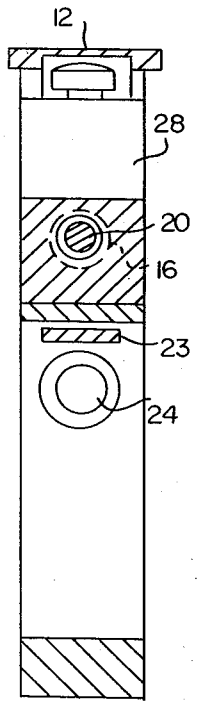
FIG. 2 is a sectional view along line A—A in FIG. 1.

The combined finger unit as above described with reference to FIGS. 1, 2 and 3 may be used to hold a fabric piece on a surface while the piece is folded as previously referred to.

FIG. 4 of the drawings shows a fabric piece 40 supported on a flat table surface 41. The fabric piece is a blank for ladies' brief having elasticised leg opening portions 42, elasticised waist band portions 43, and a gusset 44. The blank is held in position by eight combined finger units 45 of the construction previously described with reference to FIGS. 1, 2 and 3. The units are located at each end of the side edge portions 46 of the blank, which portions, when superimposed by folding the blank, will be sewn together by the side seams of the finished brief.

The section 50 of the flat surface 41 is pivotally connected to the remainder of the flat surface along the line 51. Accordingly, by pivotal movement of the section 50 through 180° in an anticlockwise direction as seen in FIG. 4, the two parts **40*a* and 40*b* of the blank are superimposed. In this superimposed position, the edges 46** of the blank are suitably aligned to be sewn together, such as by an overlocker.

It will be noted that the pivoted section 50 is narrower than the fabric piece so that when the fabric has been folded the opposite edge portions 46 of the fabric piece are exposed. This enables holding bars (not shown) to be applied to these exposed portions and press them firmly against the surface of the table. With the fabric piece so held in position the holding fingers of the combined finger units 45 may be lifted and withdrawn, and the pivotal section 50 of the bench returned to lie flat with the table top. It will be appreciated that the bench unfolds at the same time as the fingers 12 retract because otherwise the fingers could not be lifted.

The upper surface of the folded fabric piece may then be engaged by a frictional gripping device having a frictional surface which will transport the fabric piece along the surface of the table to effect sewing of the side seams. Before doing so, the holding bars are raised and the frictional gripping device is then moved to slide the folded fabric piece over the surface of the bench in any selected path. The gripping device may be in the form of the gripping device disclosed in our co-pending PCT Patent U.S. Pat. No. 4,686,914. As the sewing of the side seams only requires the folded fabric piece to move along a straight path through the sewing heads, it is not essential to use the guiding system proposed in that prior patent application, and a simple straight line guiding arrangement may be provided.

The complete disclosure in U.S. Pat. No. 4,686,916 is hereby incorporated in this specification.

In the preceeding description the movement of the gripping finger 12 while in engagement with the fabric piece has been discussed for the purpose of flatening and tensioning the fabric. Another important use of this movement is to accurately locate the particular area of the fabric piece. The gripping configuration 18 on the finger 12 engages the grippable portion of the fabric piece, such as the elasticised or hem area, and as the gripping finger will always withdraw to the fixed intermediate position, as in FIG. 3D, the engagement part of the fabric piece is in a fixed known position on the table top.

I claim:

1. A device for gripping and pulling a marginal portion of a fabric piece comprising:

(a) a base adated for attachment to a support upon which a fabric piece may be supported, (b) a finger support mounted on said base, (c) a finger mounted on said finger support to occupy a retracted position substantially at or below the surface of said support, (d) first means operable to effect reciprocal movement of the finger support relative to said base generally in the direction of the length of the finger when said finger is in an extended position in which a free end portion of the finger is above the level of said surface to locate said free end portion in gripping engagement with said marginal portion of said fabric piece, and when so located urge the withdrawal of said finger to thereby pull the fabric in the direction of withdrawal, and (e) second means mounted on said first means for selectively moving said finger to said extended position.

2. A device as set forth in claim 1 wherein a plurality of gripping fingers are used to hold and stretch the fabric piece on the respective sections of the support so as to enable subsequent folding of said fabric piece.

3. A device as set forth in claim 1 wherein the gripping fingers are located at opposite ends of said fabric piece.

4. A device as set forth in claim 1 further comprising a stop member actuated by a selectively operable fluid cylinder, mounted for reciprocal movement in a substantially vertical direction so that when the stop member is in the fully extended position the finger support responsible for the reciprocal movement of the finger will abut the stop member in an intermediate position corresponding to the stretching position of the finger.

* * * * *